US005662132A

United States Patent [19]

Larsen

[11] Patent Number: 5,662,132

[45] Date of Patent: Sep. 2, 1997

[54] STRUCTURAL PROTECTIVE SHELTER

[76] Inventor: Herbert A.F. Larsen, 35276 Rockwell Dr., Abbotsford, B.C., Canada, V3G 2C9

[21] Appl. No.: 761,355

[22] Filed: Dec. 6, 1996

[51] Int. Cl.[6] ..... E04H 15/02

[52] U.S. Cl. ..... 135/96; 135/137; 135/157; 5/414; 5/424

[58] Field of Search ..... 135/122, 137, 135/156, 157, 130, 131, 136, 145, 900–902, 96; 5/414, 424

[56] References Cited

U.S. PATENT DOCUMENTS

| | | | |
|---|---|---|---|
| 3,820,805 | 6/1974 | Tuomala | 135/901 X |
| 3,826,270 | 7/1974 | Hentges | 135/901 X |
| 4,779,294 | 10/1988 | Miller . | |
| 4,782,541 | 11/1988 | Tuchman . | |
| 4,965,895 | 10/1990 | Shustov . | |
| 5,111,543 | 5/1992 | Epshetsky et al. . | |
| 5,241,717 | 9/1993 | Ward et al. . | |
| 5,341,588 | 8/1994 | Lizotte | 135/901 X |
| 5,458,079 | 10/1995 | Matthews et al. | 135/901 X |

FOREIGN PATENT DOCUMENTS

| | | | |
|---|---|---|---|
| 0737930 | 10/1955 | United Kingdom | 135/131 |
| 2129464 | 5/1984 | United Kingdom | 135/136 |

*Primary Examiner*—Lanna Mai

[57] ABSTRACT

A structural protective shelter designed to be used around and above beds, office chairs, or anywhere an occupant may be sitting, standing, or reclining. It is ideally suited for protective use against structural building collapse resulting from disasters such as earthquakes, tornadoes, hurricanes, bomb blasts, etc. The shelter is ideally made of steel or like material and is comprised of a rectangular continuously framed base (18) from which rise four, vertical uprights (14), two pair becoming continuous to radiused corners and common overhead horizontal primary members (20). Between and perpendicular to said two overhead primary members is attached two horizontal overhead cross members (10). Between and perpendicular to said two overhead cross members is attached a handle bar grip (12) to be used to help an occupant to maintain position within the shelter during periods of violent movement. X-bracing is attached between one pair of verticals which share a common overhead primary member (22) and between the two sides of the shelter (16 and 24) as well as plate bracing (26) is attached over the rectangle shape formed by the two overhead primary members and the two overhead cross members. The four vertical uprights are designed to repel axial force of falling objects down the length of said uprights, while the bracing systems are designed to repel diagonal and lateral forces against side collapse of said shelter.

10 Claims, 3 Drawing Sheets

STRUCTURAL PROTECTIVE SHELTER

BACKGROUND—FIELD OF INVENTION

This invention provides a means of protecting an occupant from collapsing structure or falling debris during disasters such as earthquakes, tornadoes, hurricanes, bomb blasts, etc., said invention is an independent structural chamber designed to be used around and above beds, office chairs, or anywhere an occupant may be sitting, standing, or reclining.

BACKGROUND—DESCRIPTION OF PRIOR ART

Obviously, one of the greatest dangers to human life inherent with catastrophes such as included above is that of collapsing structure or falling debris. One only needs to look to the rules taught from childhood that during a potential life threatening catastrophe such as a tornado, the safest place to be is under something with vertical structure such as a door way or a desk or table with legs. These areas may be the best choice among a list of few and inferior options in that they may offer some protection from strictly axial or compression force down the length of the vertical. But they offer no protection from lateral forces such as a structure tipping over or a wall falling sideways in on a desk or doorway.

Although there exists prior art in the realm of protective structure, none address the very real and probable problem of lateral forces. Patents such as U.S. Pat. No. 4,779,294 (October 1988) to Miller, U.S. Pat. No. 4,965,895 (October 1990) to Shustov and U.S. Pat. No. 5,241,717 (September 1993) to Ward all provide for some vertical resistance against an axial force directly down the corner posts but none address that of potential diagonal or horizontal force against the top or side of the structure. Because of a lack of diagonal bracing to resist the said forces, these structures would most certainly fail under very small lateral load stresses. It is inevitable that some form of lateral force will be present in the event of a collapsed building since a structure rarely if ever collapses in a direct, vertically downward manner. In order for a ceiling or overhead structure to fall directly down, a minimum all four outside walls would have to be simultaneously forced out from under the said overhead structure so that the said overhead structure would fall directly and straightly down. In reality, a collapsing overhead structure virtually always falls with a diagonal force because supporting walls usually all tip over in one direction thereby bringing the said overhead structure down with an angle force to the vertical uprights of a protective structure. Since there was found no existing diagonal or triangular structural bracing in any prior art, it can be stated that from purely a structural engineering stand point alone, all prior art reviewed would fail the definition of a structurally protective enclosure or cage.

Another area of structure given little consideration by prior art is that of the length of the upper horizontal members. The above stated U.S. patent by Miller, along with U.S. Pat. No. 4,782,541 (November 1988) to Tuchman show two horizontal members the entire length of a bed. Although these members could be sized considerably larger than the verticals to which they are attached in order to maintain structural integrity, in a practical sense, as exposed in the said patents, they are made of a similar strength material as the verticals and are therefore susceptible to a bending moment in the center of its length. If a beam or any other narrow band of force were to fall perpendicular to and across these longitudinals there would be little to prevent these horizontal members from caving in and collapsing on the occupant.

Further to the discussion of a lack of structural integrity contained in prior art, is the issue of sub-base plate structural support. A high percentage of the substratum on which the typical invention will rest will be that of plywood over wood floor joists. Between each floor joist is a span over which the plywood structurally supports anything which exerts a downward force on it. If the base plate of a protective vertical structure happens to be located between the floor joists and directly over the span between, the entire ability of the vertical support to withstand compression and thus protect an occupant is dependent upon the structural ability of the plywood to withstand cave-in and collapsing. A patent such as U.S. Pat. No. 4,779,294 to Miller, is extremely vulnerable to this very real structural weakness in that it possesses no horizontal member near the base which may mildly impede the complete collapse of the protective structure onto the occupant. Although patents such as U.S. Pat. No. 4,782,541 (November 1988) to Tuchman and U.S. Pat. No. 4,965,895 (October 1990) to Shustov show horizontal members near the base of the said vertical supports, they are not claiming to support heavy loads against shear forces. Quoting from the above two patents in order of occurrence, Tuchman; "A protective bed comprising a lower section forming a base suitable for supporting a mattress;" and Shustov; "said shelves being of sufficient size to support a bed beneath said protective cover." The horizontal structures claimed are to support the weight of a bed and assumed occupant only and do not take into account the shear forces of a falling building in the event that the base pads of the vertical structure were to punch through a plywood floor and the "horizontal shelves" were to now bare the entire structural load while resting on the floor joists.

Other disadvantages found in the prior art of protective coverings include practicality. Simplicity and economics must enter into the design of an invention if that invention is to be considered a structural safety devise available to every consumer. If the patent gives exclusivity and the invention does not offer equal access to consumers because of economic ability, this monopoly could become a disservice to society. Therefore, it is felt that a patent such as U.S. Pat. No. 5,111,543 (May 1992) to Epshetsky et al "Bed With Foldable Earthquake Protective Cover" is impractical in that it is too complicated and prohibitively costly to produce, there is a great inherent danger to the occupant by way of the canopy covers dosing on a child or person who happens to be in the path of its closure, as well as installation of this invention into the average bedroom would be difficult if not impossible in some situations. Although other patents which feature many parts and telescopic legs such as U.S. Pat. No. 4,782,541 (November 1988) to Tuchman, may afford some protection against a direct, vertically axial compression load and therefore prove utility, they also become impractical in both construction and assembly. In the event of a disaster, where a human life is reliant on one of the said inventions, there must now, not only be a reliance on the structural integrity of the invention but a mechanical dependency as well.

Another issue to be addressed is that of the occupant remaining within the protective structure during violent movement as may be found in one of the previously stated disasters. Most prior art is reliant on the assumption that during a disaster the occupant will remain within the confines of the structural chamber and that they will thereby be protected. There exist two examples of prior art that attempted to address this issue, that of previously referred to, U.S. Pat. No. 4,965,895 (November 1990) to Shustov and U.S. Pat. No. 4,782,541 to Tuchman. In Shustov's patent, the inventor thought of this problem but addressed it in a rather awkward and impractical manner. The patent explains a method whereby there exists a ball bearing at the base of each of four vertical corner supports. Each of these bearings then float within a concave pedestal plate. The idea explained allows both the bed and the structure to float around within the concave pedestal plates thereby cushioning the occupant from being thrown out of bed. Although this may delay the horizontal movement experienced in a mild earthquake, it would, in reality, do nothing to aid the occupant in staying stationary in a more violent lateral motion, that of the nature of a wall collapsing on the side of the said structure or an explosion. In Tuchman's patent, the inventor claims a partial guard around the bed to prevent the occupant from being ejected from the chamber. Although this appears to be a superior method than that claimed in Shustov's patent, it does not afford the occupant the ability to maintain physical contact with the interior of the shelter. If the occupant were to sit up during violent movement, there exists the very real possibility of falling out over the railing since the occupant's centre of gravity, while in the sitting position, is very high.

From purely a practical application, another disadvantage found in prior art is that of the lack of diverse use. All prior art reviewed, from a logical position, is limited to bed coverings only and does not address the practical use of such protective structural chambers in offices, lobbies, living rooms and other areas of people occupancy. Although most prior art has attempted to create a safe shelter for people in the reclined position, no prior art was found to address the need of protecting people in the erect positions of sitting and/or standing. It would be completely impractical to consider locating a prior art, protective bed structure in another occupied location such as in other parts of the home or in offices etc. Because of the general, bed-covering, size and configuration of these structures, they would completely overpower and encroach on the decor and square footage of a conventional floor plan.

Since a protective, independent safety shelter should first and foremost provide structural integrity and secondarily practicality and appearance, there exists several objects and advantages to my invention.

OBJECTS AND ADVANTAGES

Accordingly, several objects and advantages of my present invention are as follows:

Structurally, my invention takes into account and makes provision for both vertically downward axial compression loads as well as lateral and diagonal forces against the side and/or end of the structural cage. The only structurally rigid geometric shape available for use in defeating lateral forces is that of the triangle therefore I have included the use of diagonal bracing on both sides, the head end and the top horizontal plane. Although some prior art may protect from falling debris such as loose drywall or wood, none are adequately equipped to withstand a collapsing structure. Therefore, since no example of prior art was found to use any structural triangulation, it can be stated, from purely a structural engineering stand point, that all prior art quoted and viewed would be considered invalid as a structurally protective cage.

Structurally, my invention also takes into account and makes provision for the problem inherent in all quoted and viewed prior art, that of the horizontal, overhead, longitudinal members being susceptible to cave in or bending at the moment or center of their span. My present invention shortens the length of these members by not spanning the entire length of the bed thereby giving them considerably greater ability to resist a load at the moment such as a beam falling perpendicularly across them. This shortening of the distance between the four vertical structural supports doubly benefits the invention by allowing for a more rigid triangular angle within the side diagonal bracings.

Structurally, my invention also takes into account and makes provision for the problem inherent in all quoted and viewed prior art, that of an inadequate base on which to mount the vertical structural supports. As discussed in the previous section, most prior art, if located on conventional plywood covered floor joists, would not adequately perform in the event of a force sufficient enough to drive the vertical structural support base plates through the plywood and between the floor joists. My present invention makes use of a common, structurally, rectangular base on which is mounted all of the vertical structural supports. This structural base would span or cover all the floor joists present under and between the corner structural verticals. With this form of a continuously perimetered base plate or foundation, it does not matter whether the floor joists, which are not normally visible under the flooring, run parallel or perpendicular to the length of the protective cage or whether the corner structural verticals happen to be cantilevered or located at a position over the plywood span between floor joists. Structural continuity would be present regardless of whether or not there existed any floor coveting spanning the void between the floor joists.

Practically, my invention takes into account and makes provision for inexpensive and simplistic construction, therefore making it available to virtually everyone regardless of economic status. The present invention is relatively light weight and compact in packaging and is easy to assemble by any person capable of reading simple assembly instructions. In an invention where safety and protection is the key issue, my present invention does not rely on any mechanical operation to support its function thus rendering its safety reliance entirely on structural integrity alone.

Practically, my invention takes into account and makes provision for a method of offering the occupant a physical means of remaining within the confines of the protective cage during violent movement. A handle bar of a comfortable grip diameter is affixed to the inside of the protective cage and located over the head of the occupant. During violent movement the occupant will reach up and grab the handle bar and hang on thus maintaining physical contact with the interior of the cage even if the cage is forced across the floor by ground movement or a wall tipping in on it. Also, the protective cage is of sufficient size that even in the event of it being tipped over, it still affords protection as long as the occupant continues to hang on. A further benefit of using this method of maintaining position within the cage, is that of the fact that during terrorization, it is human nature to want to either run oil grab hold and cling to something. If there is nothing to grab hold of, an individual may choose to run in cage's function as useles the cage's function as useless. If the reaction to violent movement is rehearsed, the natural instinct would be to reach out to the safety and security found in grabbing hold of the handle bar.

Practically, my invention takes into account and makes provision for use in other places besides bedrooms. Because of its shallower configuration, it can effectively be used against a wall, behind an office desk so that in the event of a disaster, the occupant can simply push his or her desk chair back into and under the cage, grab the handle bar and hang on until the danger subsides. My present invention also lends itself nicely to placement over chairs or love seats in office lobbies or living rooms or anywhere people may spend time.

Practically, my invention takes into account and makes provision for appearance. A bed that is completely covered by a protective cage tends to be diminished in focal point thus detracting from the conventional choice of decorating by adding colorful quilts, skirts, shams and pillows. My present invention adds weight or focal point to the head end of the bed thus tending to draw the eye over the bed and towards the head board or pillow end. My invention also lends itself nicely as a decorative piece. It can be decorated with grape vines to create a small family room arbor and used as a stand alone whereby family members can retreat in the event of a potential disaster.

Further objects and advantages of my invention will become apparent from a consideration of the drawings and ensuing description.

Reference Numerals in Drawing

10—horizontal overhead cross members (longitudinals)
12—handle bar grip
14—vertical uprights
16—side diagonal bracing
18—common rectangle base
20—horizontal overhead primary members
22—end diagonal bracing
24—perpendicular horizontal member
26—cover
P-1—axial load force at point P-1
P-2—lateral load force at point P-2
P-3—lateral load force at point P-3
P-4—lateral load force at point P-4
P-5—lateral load force at point P-5
P-6—lateral load force at point P-6
P-7—lateral load force at point P-7

DESCRIPTION OF INVENTION

Figure 1:
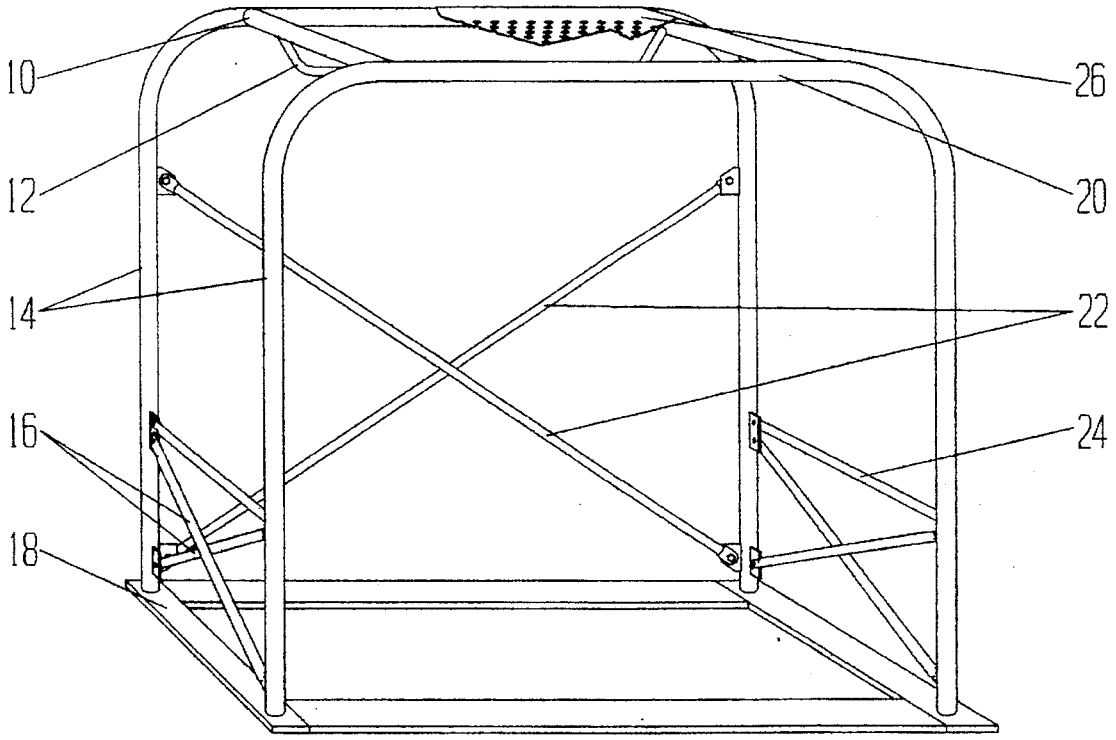
FIG. 1 is a perspective view of a structural protective shelter of the present invention.
Figure 2:
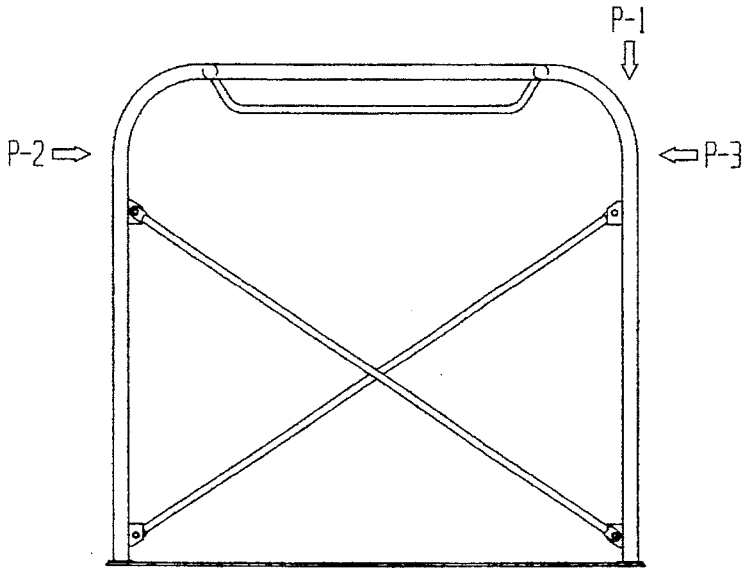
FIG. 2 is a end view of such a structure.
Figure 3:
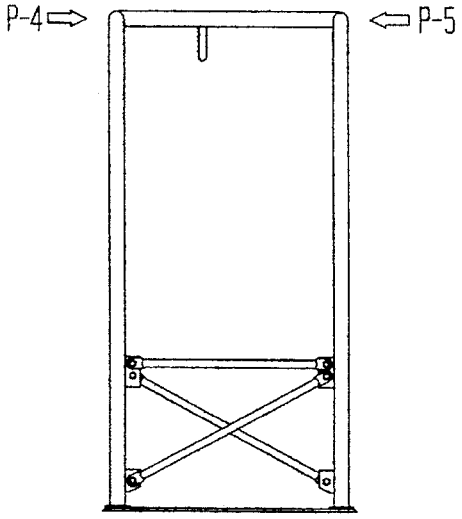
FIG. 3 is a side view of such a structure.
Figure 4:
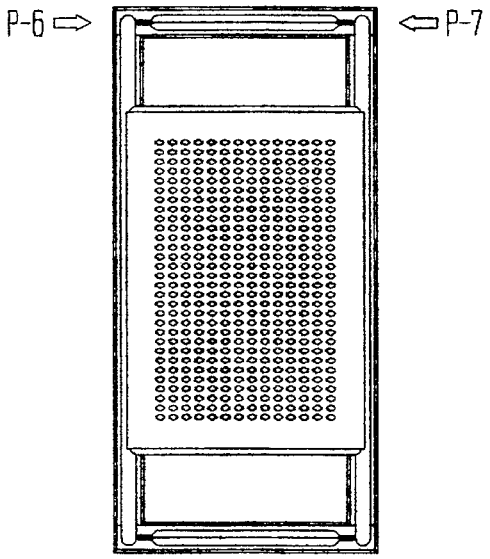
FIG. 4 is a top view of such a structure featuring a small debris protective barrier.
Figure 5:
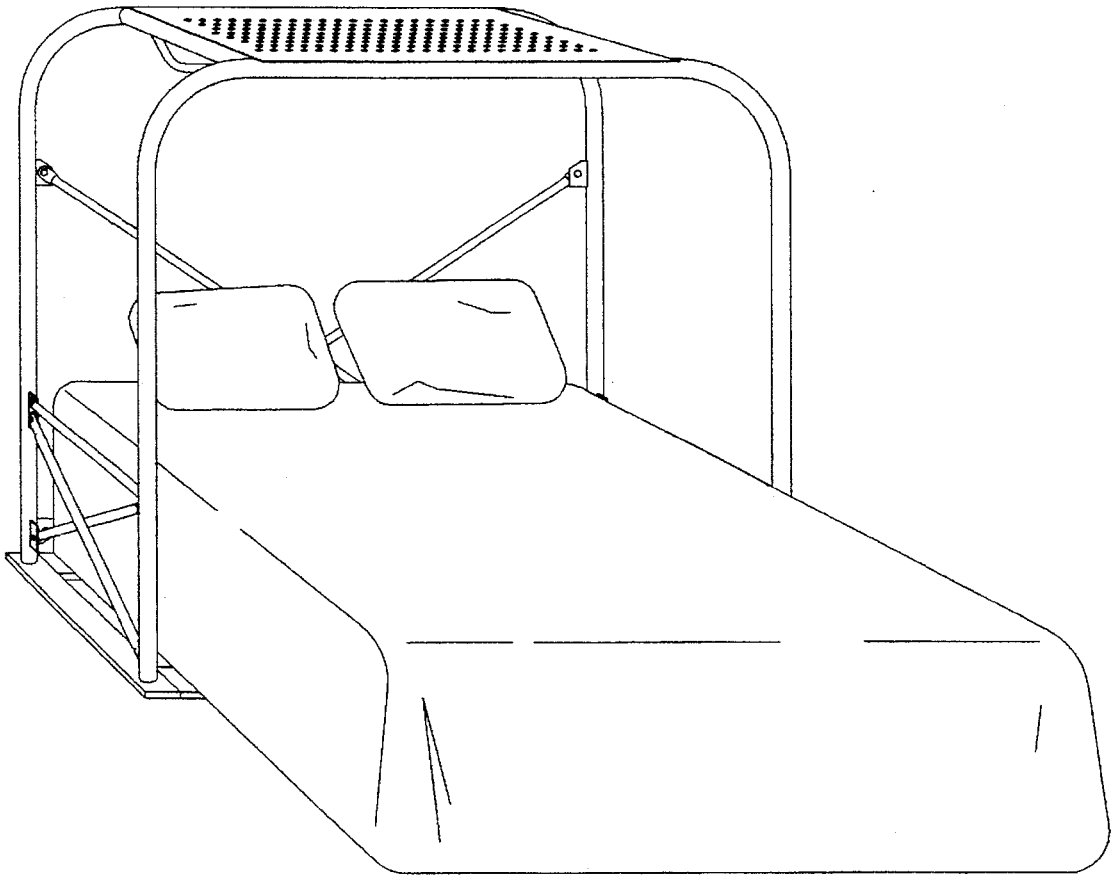
FIG. 5 is a perspective view of a structural protective shelter as used with a bed.

A typical embodiment of the structural protective shelter of the present invention is illustrated in FIG. 1 (perspective view), FIG. 2 (end view), FIG. 3 (side view), FIG. 4 (top view). The protective shelter is comprised of a rectangular base 18 of an adequate material to withstand breakage upon application of a force equivalent to that of a collapsing building structure and under whose verticals 14 may be located between adjacent floor joists. The said base 18, which is fully continuous being attached at its corners, is designed to span multiple floor joists irregardless to whether the floor joists run parallel to or perpendicular to the width of the said protective shelter.

Attached to base 18 near the center of each corner, is that of a vertical upright member 14 whose material is adequate to support a collapsing building structure of a predetermined axial load force of P-1 (as labelled in FIG. 2 of the drawings). Arranged in two pairs of verticals, each pair of said verticals rise continuous to radiused corners and a common horizontal overhead primary member 20. The said two pairs of verticals are located parallel and in mirror to each other at a distance dependent on the dimension of the longitude of the said base. Between and perpendicular to the said two horizontal overhead primary members 20, is attached two horizontal overhead cross members 10 of equal structural dimension to their perpendicular connectents. The said two cross members 10 are located parallel to each other at a symmetrical distance apart, each connectent being located near the radiused corners to the said overhead primary horizontal members 20. At a position along and attaching perpendicularly to the said two cross members 10 is attached handle bar grip 12 which is comprised of a material of grip size diameter and a structural rigidity to withstand two or more people forcibly pulling downward. The said grip 12 descends diagonally and inwardly from both sides and continuous to radiused corners and a common horizontal at a vertical drop adequate to allow an open hand to comfortably reach up and grasp the handle bar.

Between one pair of verticals 14 which share a common horizontal primary member 20 as viewed in FIG. 2, is attached near each vertical's bottom and near the point where each vertical becomes continuous to the radiuses corner that of a diagonal structural brace 22, other triangular form, or other form of bracing of adequate material to withstand a predetermined lateral load force of P-2 or P-3 (as labelled in FIG. 2 of the drawings).

Between either side of the two mirrored pairs of verticals 14 as viewed in FIG. 3 (side view), is attached that of diagonal structural bracing 16, other triangular form, or other form of bracing of adequate material to withstand a predetermined lateral load force of P-4 or P-5 (as labelled in FIG. 3 of the drawings). The vertical location of said bracing is determined, in part, by the particular application to which the protective shelter is used. In the event that the said bracing is located in the lower quadrant of the side view, a perpendicular horizontal member 24 is attached to the verticals at a location immediately adjacent to the connectent points of the top side of the said bracing 16.

Attached to and enclosing the rectangular shape formed by the two horizontal overhead primary members 20 and the two horizontal overhead cross members 10, as illustrated in FIG. 4 (top view), is a combination structural and light debris cover 26. (FIG. 1, perspective view, does not show the said cover 26, in an effort to more clearly show handle bar grip 12). Structurally, the cover is made of adequate plate material to withstand a predetermined lateral load force of P-6 or P-7 (as labelled in FIG. 4 of the drawings).

Optional to FIGS. 1–4 is the addition of an extra single trait comprised of a pair of verticals of which each pair of said verticals rise continuous to radiuses corners and a common horizontal overhead primary member 20 which matches in configuration and is identical to the two units comprising the main protective shelter. The said single unit is located at and over the foot end of a bed along with an elongated base 18 to include and become common to the said single unit as well as the inclusion and attachment of a pair of horizontal overhead cross member 10 to tie the above described head structural trait to the single foot unit.

Summary, Ramifications, and Scope

Accordingly, the reader will see that the structural as well as practical elements of this invention distinctly sets it apart from all prior art in that it manifests itself as a true structural protective shelter. The ramification of this invention in areas of potential disaster is very real in that countless lives can be spared, to say nothing of protection against minor injuries and the peace of mind that comes with knowing that one is protected from collapsing structure and falling debris. There are many advantages to this invention over that of prior art, some of the more obvious being;

it is a true structural shelter in that it makes provision for both axial force down the four vertical uprights (example: that of a roof collapsing directly down on the shelter) and lateral forces (example: that of a wall collapsing diagonally in onto the upper corners of the shelter).

it makes structural provision for a potential sharp impact force to the center of the horizontal overhead cross members.

in the event that the verticals were located above the span between floor joists, it makes provision for spreading an overall downward force across a broad based frame thereby guarding against the verticals punching through the flooring.

it is very simple and inexpensive thus allowing easy installation and a affordability to a broader base of people interested in personal safety.

it makes provision for an occupant to hang on to and remain within the internal protective area of the bed.

because of its overall compactness, it allows an occupant easier in and out access as well as in the case of use over a bed, it is easier to make the bed.

cosmetically, the invention is simple to coat with brass, chrome, and various powder coated colors.

Although the description above contains many specificities, these should not be construed as limitations on the scope of the invention, but as an exemplification of one preferred embodiment thereof. Other variations are possible, many in the realm of cosmetics, structure, and material etc. Accordingly, the scope of the invention should be determined not by the embodiments illustrated only, but by the appended claims and their legal equivalents.

What is claimed is:

1. A structural protective shelter of adequate size to accommodate one or more human occupants, said shelter being of sufficient strength and rigidity to withstand falling debris and/or collapsing building structure with a structural integrity to repel both vertically downward force as well as diagonal and lateral forces, comprising:

(a) a base with adequate dimension to support;

(b) a plurality of vertically upright members, said vertical uprights being divided into pairs with each pair rising vertically upwards and perpendicular to the said base, and becoming continuous with corners and a common horizontal overhead member where said pairs of verticals are located parallel and in mirror to each other at a distance dependent on the dimension of the longitude of the said base;

(c) between and perpendicular to the said two horizontal overhead primary members is attached a plurality of horizontal overhead cross members, said cross members being located parallel to each other at predetermined distance apart;

(d) between one pair of related vertical uprights, said uprights which share a common horizontal overhead primary member, is attached a means of bracing whereby laterally forced, side collapse of the protective shelter is impeded;

(e) between either side of each two pairs of unrelated vertical uprights, said uprights which do not share a common horizontal overhead primary member, is attached a means of bracing whereby laterally forced, longitudinal collapse of the protective shelter is impeded;

(f) between the rectangular shape formed by the outermost horizontal overhead primary members and the two horizontal overhead cross members is attached a means of bracing whereby laterally forced, diagonal collapse of the protective shelter is impeded.

2. The structural protective shelter of claim 1 wherein said protective shelter is comprised of:

(a) a rectangular shaped continuously perimetered base frame with adequate dimension to support, at the center of each of its corners;

(b) a vertically upright member, said four vertical uprights being divided into two pair with each pair rising vertically upwards and perpendicular to the said base, and becoming continuous with radiused corners and a common horizontal overhead member where the said two pairs of verticals are located parallel and in mirror to each other at a distance dependent on the dimension of the longitude of the said base;

(c) between and perpendicular to the said two horizontal overhead primary members is attached two horizontal overhead cross members of equal structural dimension to their perpendicular connectents, the said two cross members being located parallel to each other at a symmetrical distance apart, each connectent being located near the radiused corners to the said overhead primary horizontal members;

(d) between one pair of related vertical uprights, said uprights which share a common horizontal overhead primary member, is attached two diagonal members, in mirror, each commencing at a connection point near the bottom of one vertical upright and terminating at a connection point near the top of the other vertical upright;

(e) between either side of the two pairs of unrelated vertical uprights, said uprights which do not share a common horizontal overhead primary member, is attached diagonal structural bracing, each side comprised of two members in mirror, each commencing at a connection point near the bottom of one vertical upright and terminating at a predetermined connection point on the other vertical upright;

(f) immediately above each of the said two sets of side diagonal structural bracings, and parallel to the base and overhead cross members, is attached a horizontal member which spans the distance between each pair of unrelated vertical uprights;

(g) enclosing the rectangular shape formed by the two horizontal overhead primary members and the two horizontal overhead cross members is attached a combination structural/light debris plate cover.

3. The structural protective shelter of claim 2 wherein said structural bracing:

(a) between one pair of related vertical uprights, is comprised of a plate of structural material, said plate commencing at a connection point near the bottom of said vertical uprights and terminating at a connection point near the top of said vertical uprights;

(b) between either side of the two pairs of unrelated vertical uprights, is comprised of a plate of structural material, said plate commencing at a connection point near the bottom of said vertical uprights and terminating at a predetermined connection point on said vertical uprights;

(c) enclosing the rectangular shape formed by the two horizontal overhead primary members and the two horizontal overhead cross members is attached a combination structural/light debris plate cover.

4. The structural protective shelter of claim 2 wherein said structural bracing:

(a) between one pair of related vertical uprights, comprising two diagonal members, each said member commencing at a connection point near the center of the perimeter base plate between two related vertical uprights and terminating at a predetermined connection point up the nearest said related vertical upright; (b) between either side of the two pairs of unrelated vertical uprights, comprising two pairs of diagonal members, each said member of each pair, commencing at a connection point near the center of the perimeter base plate between the two unrelated vertical uprights and terminating at a predetermined connection point up the nearest said unrelated vertical upright.

5. The structural protective shelter of claim 2 wherein between the said rectangular shape formed by the two horizontal overhead primary members and the two horizontal overhead cross members is attached two diagonal members, in mirror, each commencing and terminating at diagonal connection points near the connectent points of the two horizontal overhead cross members.

6. The structural protective shelter of claim 2 wherein the said shelter is made of metal.

7. The structural protective shelter of claim 1 wherein the said shelter is made of metal.

8. The structural protective shelter of claim 1, wherein said base being of sufficient strength and rigidity to support a compressive axial load down on said vertical uprights; said vertical uprights may be cantilevered over a non-structural substratum.

9. The structural protective shelter of claim 8 wherein the said base is comprised of a continuously perimetered base frame.

10. The structural protective shelter of claim 8 wherein the said base is made of metal.

* * * * *